US007388544B2

(12) United States Patent
Bit-Babik et al.

(10) Patent No.: US 7,388,544 B2
(45) Date of Patent: Jun. 17, 2008

(54) ANTENNA WITH A SPLIT RADIATOR ELEMENT

(75) Inventors: Giorgi Bit-Babik, Sunrise, FL (US); Antonio Faraone, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 31 days.

(21) Appl. No.: 11/263,203

(22) Filed: Oct. 31, 2005

(65) Prior Publication Data

US 2007/0096996 A1 May 3, 2007

(51) Int. Cl.
*H01Q 1/24* (2006.01)

(52) U.S. Cl. ..... 343/702; 343/700 MS

(58) Field of Classification Search ..... 343/700 MS, 343/702, 829, 846
See application file for complete search history.

(56) References Cited

U.S. PATENT DOCUMENTS 6,124,831 A * 9/2000 Rutkowski et al. .. 343/700 MS
6,195,051 B1 2/2001 McCoy et al.
6,337,663 B1 1/2002 Chi-Ming
6,727,855 B1 * 4/2004 Nalbandian ..... 343/700 MS
6,995,722 B2 * 2/2006 Komatsu et al. ..... 343/711
2002/0163470 A1 * 11/2002 Nagumo et al. ..... 343/700 MS
2004/0207558 A1 * 10/2004 Saito et al. ..... 343/702
2006/0238423 A1 * 10/2006 Ozden ..... 343/702

FOREIGN PATENT DOCUMENTS

EP 1445822 B1 8/2007

* cited by examiner

*Primary Examiner*—Tho G Phan

(57) ABSTRACT

An antenna can include a dielectric substance (130), a radiator element (105) and a radio frequency feed point (135). As an example, the radiator element (105) can have at least a first portion (110) and a second portion (115) coupled to one another and folded about the dielectric substance (130). In one arrangement, the radiator element (105) can be split into a plurality of radiator branches (120, 125) in at least one of the first portion (110) and the second portion (115) of the radiator element (105).

15 Claims, 5 Drawing Sheets

200

ANTENNA WITH A SPLIT RADIATOR ELEMENT

BACKGROUND OF THE INVENTION

1. Field of Invention

The present invention relates to an antenna and a communication device that includes the antenna. More particularly, the present invention pertains to a Global Positioning System (GPS) antenna in a communication device.

2. Description Related Art

In recent years, portable communication devices have become very popular. In view of their ubiquity, such devices may be very useful in contacting emergency personnel, as it is likely that a person owning such a unit will be present at the scene of an accident or crime. As such, the Federal Communications Commission (FCC) has mandated certain standards for reliable operation of GPS applications in portable communications devices.

Although almost all portable communications devices meet or will meet the FCC standards, the reception associated with most GPS antenna is sometimes poor. In many cases, the problem is caused by difficulties associated with synthesizing an antenna pattern optimized for GPS satellite reception. In particular, many portable communications devices rely on the main subscriber antenna to capture GPS signals. Unfortunately, if the communication device is in a typical vertical position, such as clam-shell cellular phone, the main lobe of the GPS radiation pattern is generally pointed downward, which reduces the link margin with GPS satellites transmitting from the upper hemisphere. In fact, in many cases, the GPS radiation pattern features a null pointing upward towards the GPS satellites. Radio frequency (RF) currents flowing on the phone chassis, particularly the lower portion of a clam-shell handset, are generally seen as the root of this problem.

SUMMARY OF THE INVENTION

The invention concerns an antenna and a communication device comprising the antenna.

The antenna can comprise a dielectric substance, a radiator element and at least one radio frequency feed point coupled to the radiator element. The antenna can further comprise a ground plane, which can be coupled to the dielectric substance. The radiator element can have at least a first portion and a second portion coupled to one another and folded about the dielectric substance such that the radiator element is split into a plurality of radiator branches in at least one of the first portion and the second portion of the radiator element. At least one region can be located between the plurality of radiator branches such that one or more components can be positioned in the region. The radiator element can be positioned on the dielectric substance or can also be positioned on the inside surface of a housing of a wireless communication device. The admittance of the first portion of the radiator element can be at least substantially equal to the admittance of the second portion of the radiator element.

The radio frequency feed point can be provided in the first portion or the second portion of the radiator element. The radio frequency feed point can further be conductively, magnetically or capacitively coupled to the ground plane. The radio frequency feed point can be an unbalanced feed point. In an embodiment of the present invention, the dielectric substance can be partially comprised of air. In another arrangement, the radiator element can be a self-consistent antenna, and the dielectric substance can be folded about the ground plane. Also, the radiator element can be contained within a wireless communication device having a flip portion and a base portion.

In another embodiment of the present invention, a communication device is provided. The communication device can comprise a ground plane, a dielectric substance surrounding at least a portion of the ground plane, a radiator element having a first portion and a second portion coupled to one another and a radio frequency feed point coupled to the radiator element. The radiator element can be folded about the dielectric substance, and at least one of the first portion and the second portions of the radiator elements can contain multiple segments that are separated by a distance that can permit components coupled to the ground plane to be positioned between the segments. The admittance of the first portion of the radiator element can be substantially equal to the admittance of the second portion of the radiator element. The communication device can be a wireless communication device, and at least one of the components can be a transducer. The communication device can further comprise a housing wherein the radiator element can be positioned on the dielectric substance or on an inside surface of the housing.

In an exemplary embodiment of the present invention, a wireless communication device, for example, a mobile phone, can incorporate the ground plane and the radiator element or antenna. The antenna in the wireless communication device can be such that the first portion and the second portion of the radiator element can contain multiple segments that are separated by a distance that can permit components coupled to the ground plane to be positioned between the segments.

In view of the unique design of the antenna, improved performance in certain frequencies and better use of space can be realized in wireless communication devices. In one particular arrangement, the invention can improve the signal reception for a communication device receiving GPS signals.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements.

DETAILED DESCRIPTION OF THE INVENTION

Figure 1:
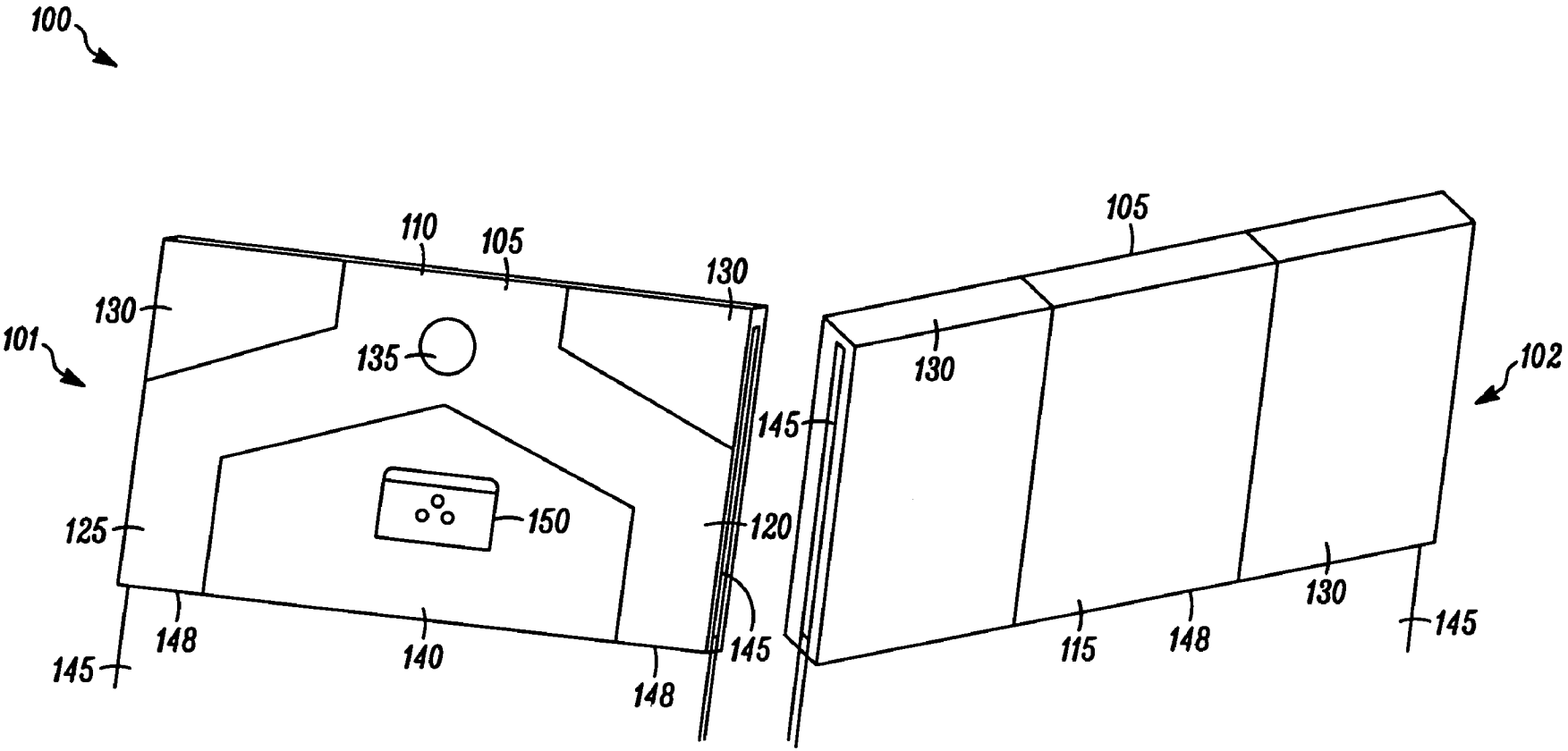
FIG. 1 illustrates an antenna in accordance with an embodiment of the inventive arrangements.

While the specification concludes with claims defining the features of the invention that are regarded as novel, it is believed that the invention will be better understood from a consideration of the following description in conjunction with the drawing figures, in which like reference numerals are carried forward.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically. The terms "program", "software application", and the like as used herein, are defined as a sequence of instructions designed for execution on a computer system. A "program", "computer program", or "software application" may include a subroutine, a function, a procedure, an object method, an object implementation, an executable application, an applet, a servlet, a source code, an object code, a shared library/dynamic load library and/or other sequence of instructions designed for execution on a computer system.

The present invention relates to an antenna and a communication device comprising the antenna, which can enable a user to use the communication device in various positions with uniform coverage and improved signal reception. More particularly, the present invention relates to an antenna in a communication device, which can improve GPS signal reception and quality.

FIG. 1 illustrates an antenna 100 having a front view 101 and a rear view 102 in accordance with an embodiment of the present invention. The antenna 100 can comprise a dielectric substance 130, a radiator element 105 and at least one radio frequency feed point 135. The radiator element 105 may have at least a first portion 110 and a second portion 115 coupled to one another and can be folded about the dielectric substance 130. As an example, the radiator element 105 can be split into a plurality of radiator branches 120 and 125 in at least one of the first portion 110 and the second portion 115 of the radiator element 105. Although only two branches 120, 125 are shown in FIG. 1, it is understood that the first portion 110 and/or the second portion 115 may include any suitable number of such branches.

The radio frequency feed point 135 can be coupled to the radiator element 105 in either the first portion 110 or the second portion 115, or even both. Those skilled in the art will appreciate that the plurality of radiator branches 120 and 125 can be provided in either the first portion 110 or the second portion 115 or both the first portion 110 and the second portion 115 or any other suitable portion(s) of the radiator element 105, and the invention shall have the full scope of the claims. As another example, the branches 120, 125 may be parallel to one another, which is the configuration shown in FIG. 1. It is understood, however, that the invention is not so limited, as the plurality of branches can be positioned in any other suitable fashion. As an example, the branches 120, 125 may have a substantially equivalent length of approximately one-half of a wavelength, although those of skill in the art will appreciate that other configurations are within the scope of the invention.

In one arrangement, the dielectric substance 130 can be coupled to and folded about a ground plane 145. In addition, the radio frequency feed point 135 can be conductively, magnetically or capacitively coupled to the ground plane 145. It is understood, however, that the ground plane 145 is optional in this configuration. Those of skill in the art will appreciate that the invention may include more than one radio frequency feed point 135 if no ground plane 145 is included.

The radiator element 105 may also include one or more radiating edges 148. As an example, both the first portion 110 and the second portion 115 may have radiating edges 148. Also, if the first portion 110 or the second portion 115 includes the plurality of branches 120, 125, the branches 120, 125 may also include radiating edges 148, as seen in FIG. 1. As is known in the art, the radiating edges 148 are the location of the radiating element 105 where most of the radiation from the radiating element 105 originates.

The radiator element 105 can be provided such that the admittance of the first portion 110 of the radiator element 105 can be at least substantially equal to the admittance of the second portion 115 of the radiator element 105. In particular, the per-unit-length (PUL) admittance of the radiating element 105 can be substantially constant along the length of the radiating element 105, such as from the radiating edge(s) 148 of the first portion 110 to the radiating edges(s) 148 of the second portion 115. This arrangement may also apply if one or both of the first portion 110 and the second portion 115 include a plurality of branches 120, 125. That is, the PUL admittance of the branches 120, 125 may be combined to form the admittance of the portion of the radiator element 105 containing the branches 120, 125. In any event, by having the admittance of the radiating element 105 substantially constant along its length can ensure that radiating currents can flow from one radiating edge 148 to another with minimal reflection along the current path.

In one arrangement, the radiator element 105 can be a self-consistent antenna, which, as is known in the art, can mean that the radiator element 105 does not necessarily rely on the ground plane 145 to resonate. As such, as those of skill in the art will appreciate, RF currents on the ground plane 145 can be relatively weak outside the projection area of the radiator element 105 and do not substantially affect the performance of the antenna 100. Those of skill in the art will also appreciate that because the ground plane 145 may be sandwiched between the dielectric substance 130, the radio frequency feed point 135 can be an unbalanced feed point, which can employ unbalanced feed lines, such as coaxial cables, striplines and microstrip lines. Using an unbalanced transmission line on the ground lane 145 to originate the radio frequency feed can eliminate the need for introducing a balun to feed the radiator element 105.

Figure 2:
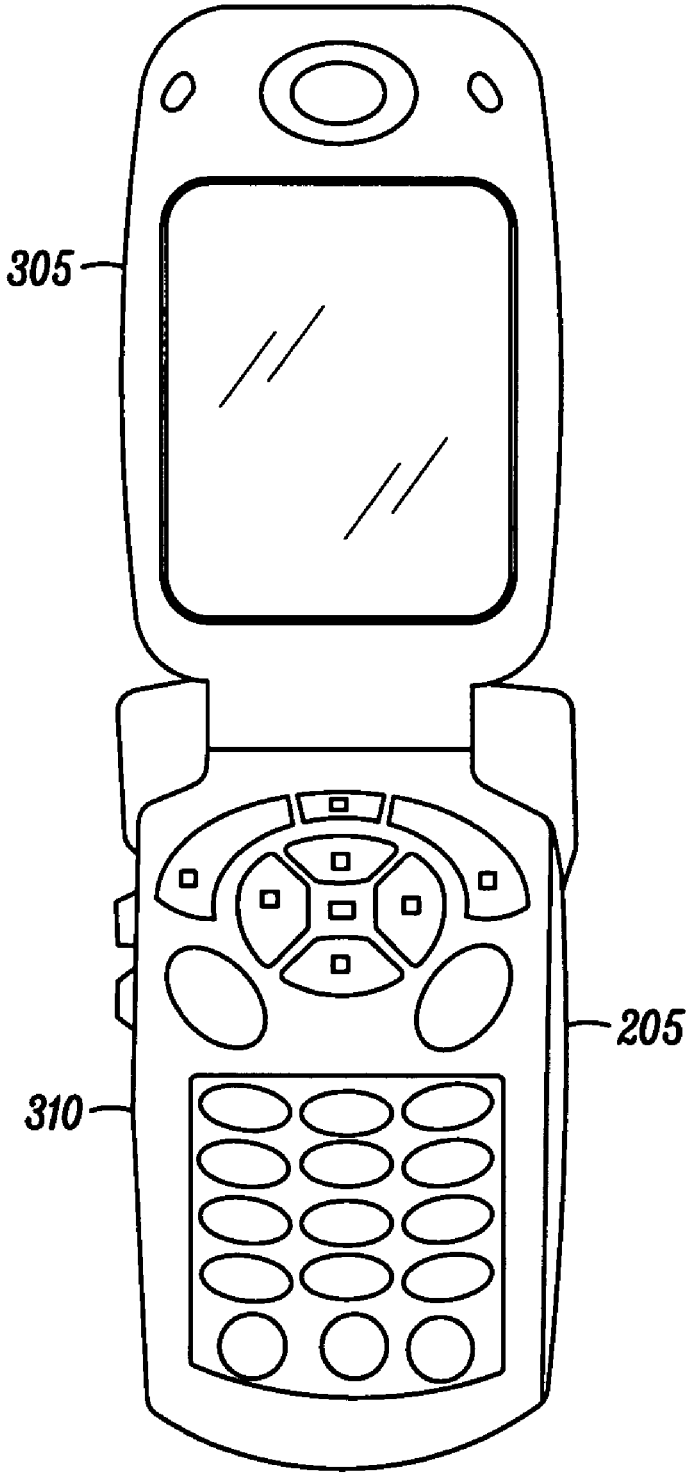
FIG. 2 illustrates a communication device that can incorporate the antenna of FIG. 1 in accordance with another embodiment of the inventive arrangement.

In an embodiment of the present invention, the radiator element 105 can be positioned on the dielectric substance 130. The dielectric substance 130 can comprise at least one of air, ceramic, mica, glass, plastics and oxides of various metals. The dielectric substance can also partially comprise of air. For example, the dielectric substance 130 can partially comprise ceramic and partly comprise air. To describe how the dielectric substance 130 can be air, reference is made to FIGS. 1 and 2, which shows a wireless communication device 200 that can incorporate the antenna 100 of FIG. 1. In one arrangement, the device 200 can include a housing 205 having an inside surface (not shown), and the radiator element 105 of the antenna 100 can be positioned on the inside surface of the housing 205. An air gap can exist between the radiator element 105 and the ground plane 145, and the air gap can serve as the dielectric substance 130. In this example, the radio frequency feed point 135 can be coupled to the radiator element 105 and/or the ground plane 145 in accordance with any suitable manner.

Referring once again to FIG. 1, in a particular embodiment of the present invention, at least one region 140 can be provided between the plurality of radiator branches 120 and 125 such that one or more components 150 can be positioned in the region 140. For example, the component 150 can be coupled to the ground plane 145 and may be a speaker, a camera, a microphone or any other suitable element of the communications device 200 (see FIG. 2) that can be appropriately situated in the region 140.

Figure 3:
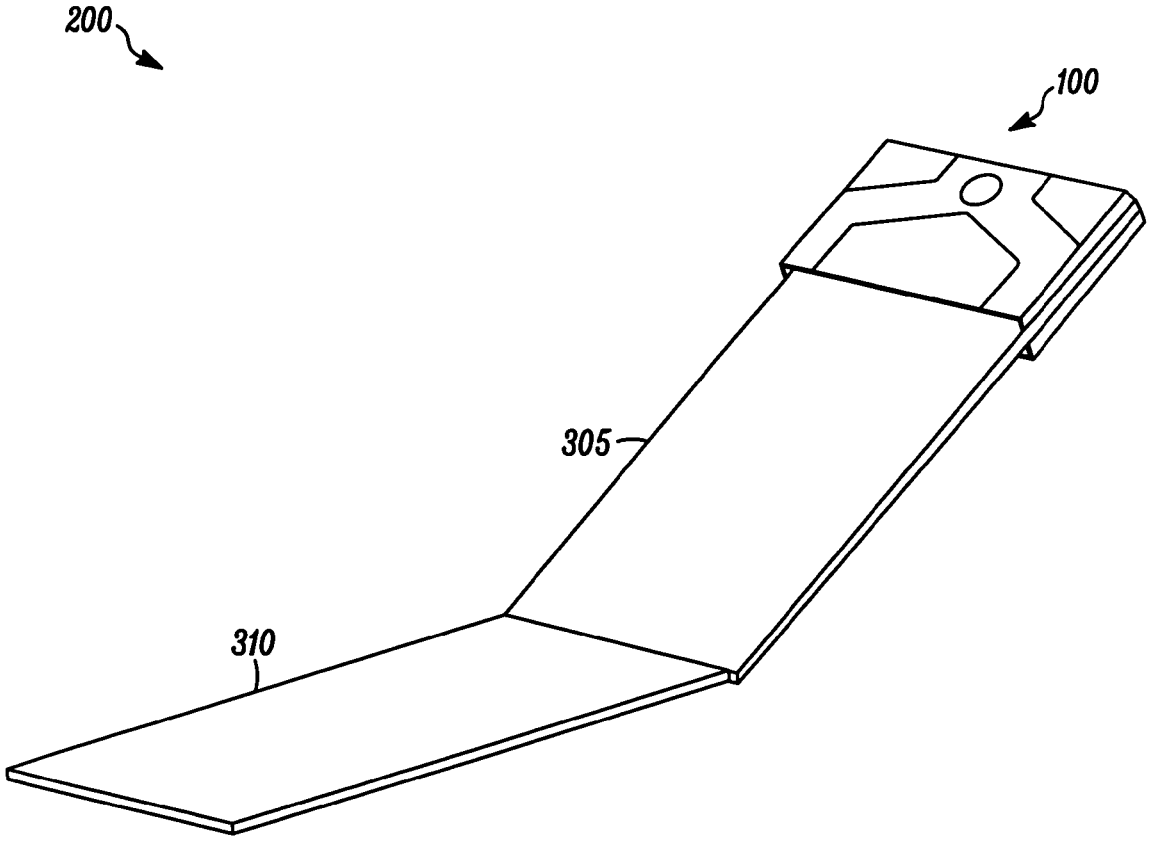
FIG. 3 illustrates a portion of the communication device of FIG. 2 in accordance with an embodiment of the inventive arrangements.

Referring to FIG. 2 again, as an example, the wireless communication device 200 may include a flip portion 305 and a base portion 310. Referring to FIG. 3, an example representing the flip portion 305 and the base portion 310 of the communication device 200 is shown. Although such an arrangement relates to a clam-shell or flip-type cellular telephone, it is understood that the invention is not limited to such a device. The antenna 100 can be implemented in any other suitable communications product. The antenna 100 can be incorporated in at least one of the flip portion 305 or the base portion 310 of the device 200. In an exemplary embodiment of the present invention and as shown here, the antenna 100 can be positioned on the flip portion 305 of the device 200. In another embodiment of the present invention and as noted earlier, the antenna 100 can be positioned on the inside surface of the housing 205 (see FIG. 2) of the wireless communication device 200.

The present invention presents several advantages. For example, because the radiator element 105 can be a self-consistent antenna, RF currents on the ground plane may be weak. Because they are weak, these RF currents do not substantially affect the radiation pattern of the radiator element 105. This principle also applies if a user places his or her hand on the communication device 200. Moreover, because the ground plane 145 can be sandwiched between the dielectric substance 130, an unbalanced transmission line can be used with the radio frequency feed point 135. That is, the need for a balun may be eliminated. By using an unbalanced transmission line, less space is required to implement the antenna 100 in the communication device 800 and the ground plane 145 can maintain its isolation properties.

Figure 4:
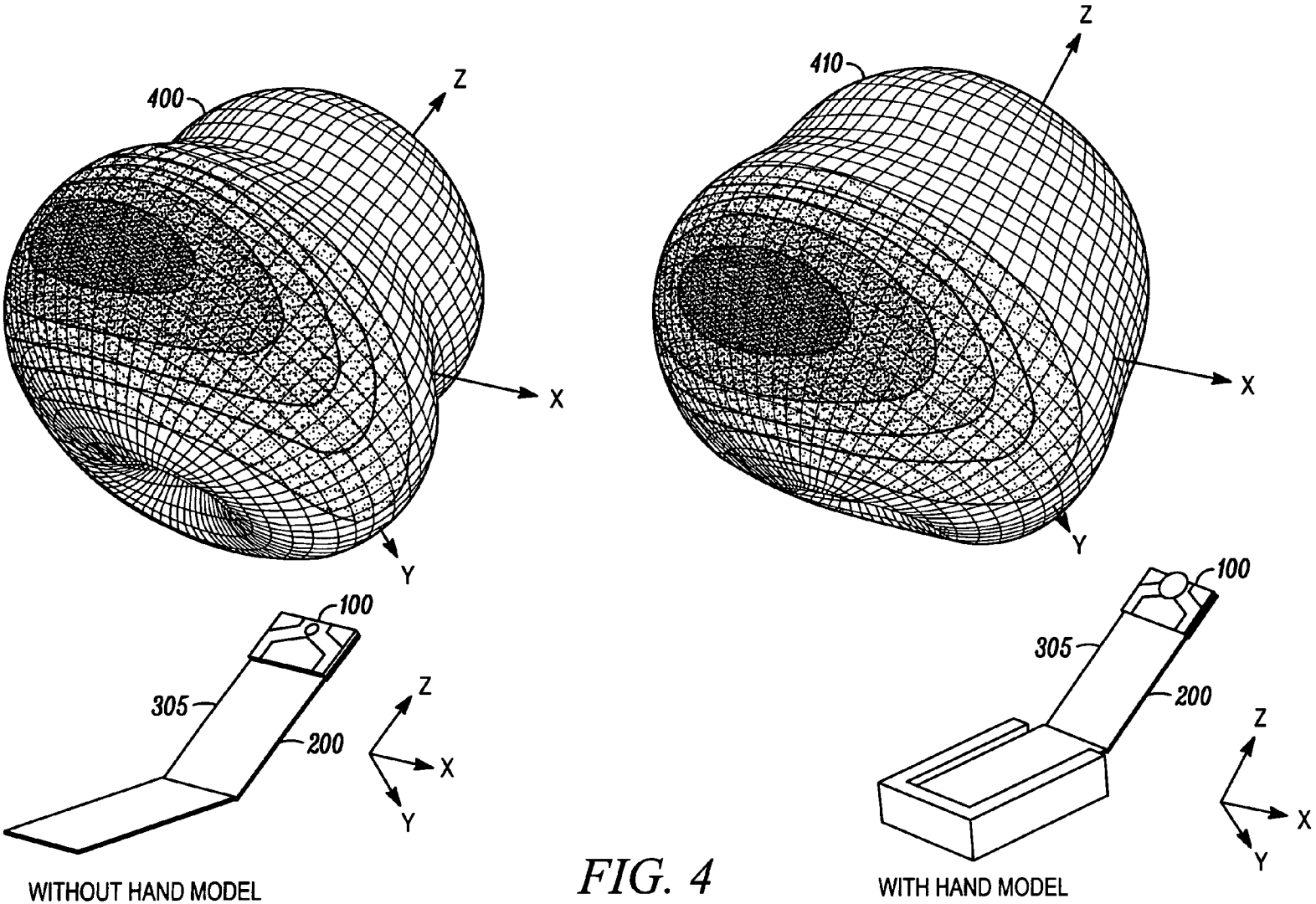
FIG. 4 illustrates radiation patterns generated by an antenna of a wireless communication device in accordance with one embodiment of the inventive arrangements.

The antenna 100 can be designed to operate in any suitable frequency or range of frequencies. In one particular arrangement, the antenna 100 can be designed to receive GPS signals for the communication device 200. As shown in FIG. 4, a radiation pattern 400 and a radiation pattern 410 of the antenna 100 in the communication device 200 is shown. The radiation pattern 400 represents a pattern if a user's hand is not holding the communication device 200, and the radiation pattern 410 represents a pattern if a user's hand is holding the device 200. The radiation patterns 400, 410 are also shown in relation to a particular positioning of the communication device 200. In particular, if the communication device 200 is a clam-shell or flip-type handset, the X, Y and Z axes of the patterns 400 and 410 can be positioned to correspond to the flip portion 305 of the device 200. Also, the darker shaded areas of the patterns 400, 410 can represent the areas where signal reception is strongest.

As can be seen, both radiation patterns 400, 410 are optimized for signal reception, and no nulls are present. This feature is based on the unique design of the antenna 100 and is irrespective of whether a using is holding the communication device 200. Further, the signal strength of the radiation patterns 400, 410 can be maximized for signal reception from the open sky, such as for receiving GPS signals from GPS satellites. Of course, it must be stressed that the invention is not limited to being implemented in a clam-shell handset or for receiving GPS signals.

Figure 5:
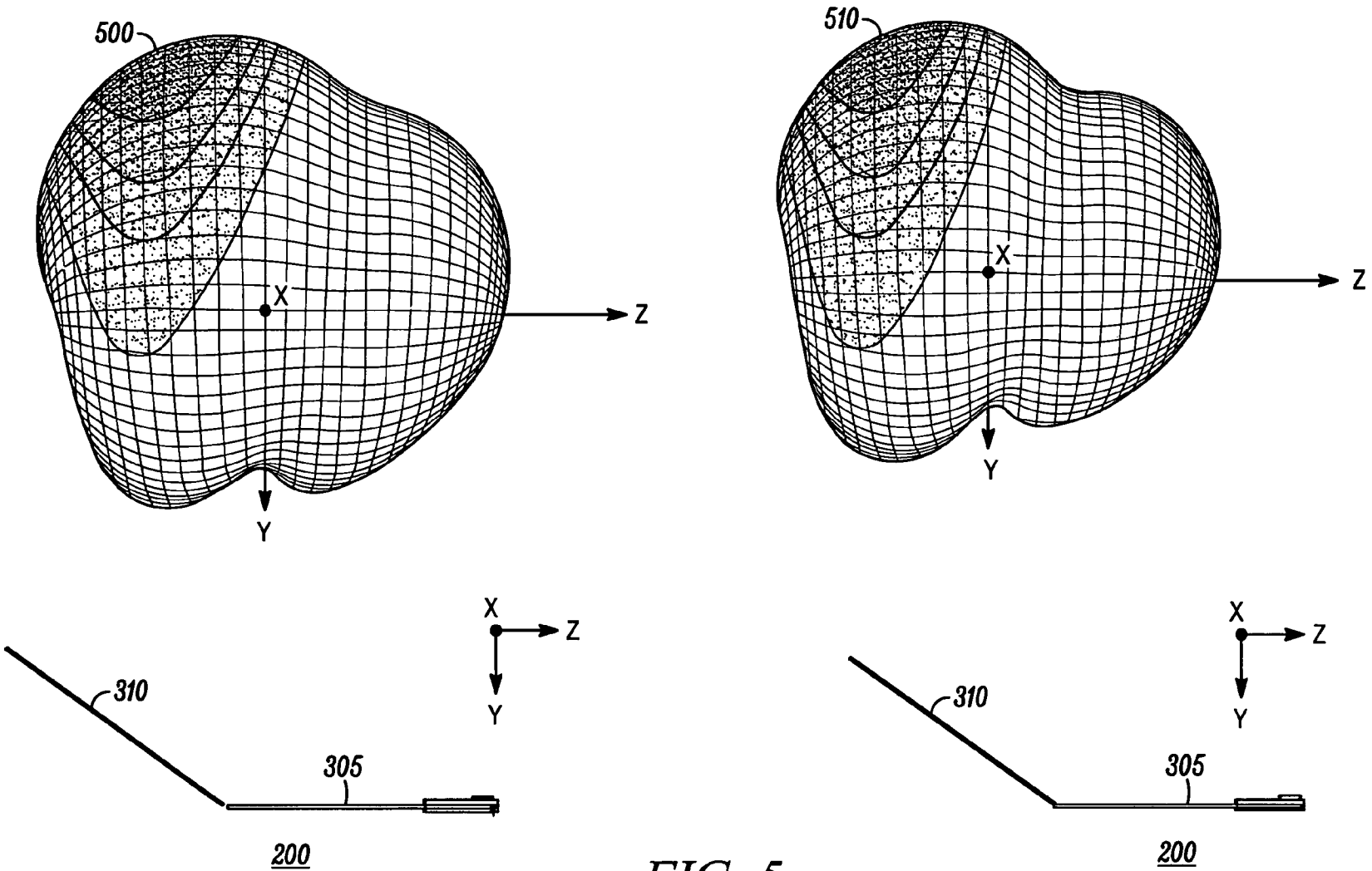
FIG. 5 illustrates more radiation patterns generated by an antenna in a wireless communication device in accordance with an embodiment of the inventive arrangements.

FIG. 5 shows a radiation pattern 500 and a radiation pattern 510 generated from the communication device 200 in which the communication device 200 is a clamshell phone having a flip portion 305 and a base portion 310, in accordance with an embodiment of the present invention. Similar to the radiation patterns 400, 410 of FIG. 4, the X, Y and Z axes can correspond to the flip portion 305 of the device 200 (the X-axis here comes out of the paper towards the viewer), and the darker areas of the patterns 500, 510 can represent areas of stronger signal reception.

Radiation pattern 500 can represent the radiation pattern produced if the flip portion 305 is electrically disconnected from the base portion 310, and radiation pattern 510 can represent the pattern if the flip portion 305 and the base portion 310 are electrically connected. In view of the unique design of the antenna 100, it can be seen that the performance of the antenna is not substantially affected by the electrical connection or disconnection of the flip portion 305 and the base portion 310.

In a more general embodiment of the present invention, the antenna specified in the present invention can be used not only to receive but also to transmit radio frequency signals. The radio frequency signals include but are not limited to GPS signals. The antenna specified herein can be used, in a portable communication device, wherein the portable communication device is not limited to cellular phones. Further the antenna specified herein can be mounted either on the flip portion or on the base portion of a clam-shell phone and is not only limited to the flip portion. Mounting the antenna on the base portion of a clamshell phone lies within the scope of the present invention. Skilled artisans shall appreciate the advantages of the present invention, including ease of use, quality of reception, improved radiation patterns, and the advantage of incorporating additional components such as an earpiece or speaker, as described above. The invention also offers the advantage of reduced radio frequency currents in the communication device. The invention improves the performance of a communication device and enables GPS navigation with improved quality and ease of use.

This disclosure is intended to explain how to fashion and use various embodiments in accordance with the invention rather than to limit the true, intended and fair scope and spirit thereof. The foregoing discussion is not intended to be exhaustive or to limit the invention to the precise forms disclosed. Modifications or variations are possible in the light of the above teachings. The embodiment(s) was chosen and described to provide the best illustration of the principles of the invention and practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally and equitably entitled.

What is claimed is:

1. An antenna comprising:

a dielectric substance;

a radiator element having at least a first portion and a second portion coupled to one another and folded about the dielectric substance such that the radiator element is split into a plurality of radiator branches in at least one of the first portion and the second portion of the radiator element; and at least one radio frequency feed point coupled to the radiator element;

wherein a transducer or camera is positioned between the radiator branches of the first portion.

2. The antenna of claim 1, further comprising a ground plane coupled to the dielectric substance.

3. The antenna of claim 2, wherein the radio frequency feed point is conductively, magnetically or capacitively coupled to the ground plane.

4. The antenna of claim 2, wherein the dielectric substance is folded about the ground plane.

5. The antenna of claim 1, wherein the radio frequency feed point is provided in the first portion or the second portion of the radiator element.

6. The antenna of claim 1, wherein the admittance of the first portion of the radiator element is at least substantially equal to the admittance of the second portion of the radiator element.

7. The antenna of claim 1, wherein the radio frequency feed point is an unbalanced feed point.

8. The antenna of claim 1, wherein the radiator element is positioned on the dielectric substance.

9. The antenna of claim 1, wherein the radiator element is a self-consistent antenna.

10. The antenna of claim 1, wherein the radiator element is contained within a wireless communication device having a flip portion and a base portion.

11. The antenna of claim 1, wherein the radiator element is split into the plurality of radiator branches in the first portion of the radiator element.

12. A communication device, comprising:

a ground plane;

a dielectric substance surrounding at least a portion of the ground plane;

a radiator element having a first portion and a second portion coupled to one another, wherein the radiator element is folded about the dielectric substance and wherein one or both of the first portion and the second portions of the radiator elements contain multiple segments that are separated by a distance that permits components coupled to the ground plane to be positioned between the segments; and, a radio frequency feed point coupled to the radiator element;

wherein the communication device is a wireless communication device and at least one of the components is a transducer or a camera.

13. The communication device of claim 12, wherein the admittance of the first portion of the radiator element is at least substantially equal to the admittance of the second portion of the radiator element.

14. The communication device of claim 12, wherein the radiator element is a self-consistent antenna.

15. The communication device of claim 12, wherein the dielectric substance is folded about the ground plane.

* * * * *